US010457010B2

(12) United States Patent
Schell et al.

(10) Patent No.: US 10,457,010 B2
(45) Date of Patent: Oct. 29, 2019

(54) CORRUGATING ROLL

(71) Applicant: BHS Corrugated Maschinen-und Anlagenbau GmbH, Weiherhammer (DE)

(72) Inventors: Markus Schell, Weiden (DE); Norbert Städele, Parkstein (DE); Alfons Gnan, Vilseck (DE)

(73) Assignee: BHS Corrugated Maschinen-und Anlagenbau GmbH, Weiherhammer (DE)

( * ) Notice: Subject to any disclaimer, the term of this patent is extended or adjusted under 35 U.S.C. 154(b) by 149 days.

(21) Appl. No.: 15/428,323

(22) Filed: Feb. 9, 2017

(65) Prior Publication Data

US 2017/0232699 A1 Aug. 17, 2017

(30) Foreign Application Priority Data

Feb. 11, 2016 (DE) ..... 10 2016 202 099

(51) Int. Cl.
*B31F 1/28* (2006.01)

(52) U.S. Cl.
CPC ..... *B31F 1/2863* (2013.01); *B31F 1/2804* (2013.01)

(58) Field of Classification Search
None
See application file for complete search history.

(56) References Cited

U.S. PATENT DOCUMENTS

| | | | |
|---|---|---|---|
| 494,271 | A | 3/1893 | Dodd |
| 4,344,379 | A | 8/1982 | Roberts |
| 2003/0069120 | A1 | 4/2003 | Papsdorf et al. |

FOREIGN PATENT DOCUMENTS

| | | | |
|---|---|---|---|
| DE | 838 416 | C | 5/1952 |
| DE | 885 220 | C | 8/1953 |
| DE | 15 61 516 | A1 | 5/1970 |
| DE | 10 2011 017 487 | A1 | 10/2012 |
| GB | 606 490 | A | 8/1948 |

OTHER PUBLICATIONS

Machine translation of DE 885220 (Year: 1949).*
Machine translation of DE 838416 (Year: 1949).*
Machine translation of DE 1561516 (Year: 1970).*
Machine translation of DE 102011017487 (Year: 2012).*

* cited by examiner

*Primary Examiner* — Barbara J Musser
(74) *Attorney, Agent, or Firm* — McGlew and Tuttle, P.C.

(57) ABSTRACT

The invention concerns a corrugating roll for producing a corrugated web, having a fluting, from a material web. The corrugating roll has a corrugating roll body, a central longitudinal axis, a peripheral direction about the central longitudinal axis and a surface fluting with at least one first corrugating tooth, which is arranged peripherally on the corrugating roll body, and at least one second corrugating tooth arranged peripherally on the corrugating roll body and which differs from the at least one first corrugating tooth for reducing corrugating roll operation-related vibrations.

20 Claims, 6 Drawing Sheets

CORRUGATING ROLL

CROSS-REFERENCES TO RELATED APPLICATIONS

This application claims the priority of German Patent Application, Serial No. 10 2016 202 099.4, filed Feb. 11, 2016, pursuant to 35 U.S.C. 119(a)-(d), the content of which is incorporated herein by reference in its entirety as if fully set forth herein.

FIELD OF THE INVENTION

The invention concerns a corrugating roll producing a corrugated web with a fluting from a material web. Furthermore, the invention deals with a device for manufacturing a corrugated cardboard web with at least one of this type of corrugating roll. The invention also concerns a method for manufacturing a corrugating roll of this type.

BACKGROUND OF THE INVENTION

It is known that conventional corrugated cardboard webs or corrugated cardboards have at least one corrugated web with sinusoidal fluting. The corrugated web is generally laminated with two webs, one on each side. These types of corrugated webs are formed mostly from a smooth or flat material web in a corrugating slit between two rotating corrugating rolls which have a corrugated profile like two toothed gear wheels meshing with each other. The disadvantage in this is that, as the corrugating rolls operate, they are set in vibration, the usual result of which is that the corrugated webs are not impressed optimally.

SUMMARY OF THE INVENTION

The invention is therefore based on an object of producing a corrugating roll with particularly low vibrations when it is being used. The particular aim is to avoid even-numbered subharmonic frequencies or, respectively, the even-numbered higher harmonic frequencies occurring in the corrugating roll as it is operating. The aim also is to produce a device for manufacturing a corrugated cardboard web with particularly low vibrations as it operates. Furthermore, it is intended to provide a method for manufacturing a corrugating roll with extremely low vibrations.

This object is resolved, according to the invention, by a corrugating roll for producing a corrugated web, having a fluting, from a material web, with a corrugating roll body, with a central longitudinal axis, with a peripheral direction about the central longitudinal axis, and with a surface fluting, which has at least one first corrugating tooth, arranged peripherally on the corrugating roll body, and at least one second corrugating tooth, which is arranged peripherally on the corrugating roll body and which differs from the at least one first corrugating tooth for reducing corrugating roll operation-related vibrations.

The object of the invention is further resolved by a device for producing a corrugated cardboard web, comprising a corrugating device for producing a corrugated web, having a fluting, from a material web, wherein the corrugating device comprises at least one corrugating roll according to any one of the invention, an adhesive applicator to apply adhesive to tips of the fluting of the corrugated web, and a pressing device to press a liner web on to the glue-covered tips of the corrugated web.

The object of the invention is further resolved by a method for producing a material web corrugating roll, comprising the steps providing of a corrugating roll basic body with basic corrugating teeth, and machining the basic corrugating teeth upon forming at least one first corrugating tooth and at least one second corrugating tooth, such that the at least one second corrugating tooth differs from the at least one first corrugating tooth for reducing corrugating roll operation-related vibrations.

The essence of the concept is that the corrugating roll has corrugating teeth which differ from each other, particularly in their shape or design, to reduce operation-related vibrations, that is, vibrations while they are operating. At least one second corrugating tooth is different from the at least one first corrugating tooth or, respectively, at least one first corrugating tooth is different from the at least one second corrugating tooth. In this manner, vibrations or resonant frequencies of the corrugating roll can be minimised or suppressed. In particular, harmonic and/or subharmonic vibrations can be reduced. This is beneficial for the service life of the corrugating roll and for the device for manufacturing a corrugated cardboard web comprising at least one corrugating roll of this type. Operating noise can be minimised. Finally, the quality of the produced corrugated web or corrugated cardboard web is also increased since its fluting is impressed in a particularly clean and uniform manner.

It is advantageous if the corrugating roll is driven directly or indirectly and is rotated during operation about its central longitudinal axis which then forms a rotational axis or pivot axis.

Preferably, the surface fluting has corrugating teeth and corrugating tooth valleys arranged alternately. It is advantageous if a plurality of the first corrugating teeth and/or of the second corrugating teeth is present. In this, the first corrugating teeth are preferably identical. Here also, the second corrugating teeth are preferably identical. The at least one first corrugating tooth is preferably symmetrical in cross section. The at least one second corrugating tooth can be designed to be symmetrical or asymmetrical in cross section.

Second corrugating teeth can be provided in a peripheral direction following directly one after the other or with at least one intermediate first corrugating tooth. First corrugating teeth can be provided in a peripheral direction following directly one after the other or with at least one intermediate second corrugating tooth.

The corrugating roll may also comprise at least one further corrugating tooth which differs from the at least one first and second corrugating teeth.

It is advantageous if the corrugating roll is configured in one piece. Preferably, the at least one first corrugating tooth and the at least one second corrugating tooth are connected with the corrugating roll body such as to form 20 one piece therewith or they are configured in one piece therewith.

Preferably, two corrugating rolls form a corrugating device to corrugate the material web and mesh with each other or engage into each other. When operating, preferably the corrugating teeth of a first corrugating roll engage in the corrugating tooth valleys of a second corrugating roll while the corrugating teeth of the second corrugating roll engage in the corrugating tooth valleys of the first corrugating roll. By doing so, the smooth or flat material web fed through a corrugating slit or roll gap delimited between the corrugating rolls is permanently formed.

It is advantageous if the device to manufacture a corrugated cardboard web also comprises an adhesive applicator to apply adhesive to the tips of the fluting of the corrugated web.

Furthermore, it is expedient if the device to manufacture a corrugated cardboard web has a pressing device to press a liner web on to the glue-covered tips of the corrugated web. Preferably, the pressing device has at least one pressing roll or a pressure belt module with a guided continuous pressure belt to press the liner web against the glued corrugated web. The pressure belt module preferably has a belt-tensioning and/or belt adjustment device for tensioning the pressure belt, or controlling the path or lateral position of the pressure belt. An arrangement without this type of belt-tensioning and/or belt adjustment device is possible as an alternative.

It is advantageous if the machining of the basic corrugating teeth to manufacture the corrugating roll is carried out by metal removal, in particular by grinding.

According to the invention, the at least one first corrugating tooth and the at least one second corrugating tooth differ from each other, at least regionally, in terms of their tooth shape or tooth geometry. Preferably, they have different cross sections.

According to the invention, the at least one first and second corrugating teeth differ, at least regionally, in terms of their crest shape or crests. In particular, the at least one first and second corrugating teeth have different cross sections in their crest regions.

According to the invention, the crest curvatures of the at least one first and second corrugating teeth are different, at least regionally. It is advantageous if, in its first crest region, the at least one first corrugating tooth has one first crest curvature radius, at least regionally, which is between 0.9 mm and 1.9 mm. Preferably, in its second crest region, the at least one second corrugating tooth has a second crest curvature radius which is smaller or greater than the first crest curvature radius.

According to the invention, the at least one first and second corrugating teeth differ in terms of their respective, particularly maximum, radial tooth height measured from the corrugating roll body, wherein preferably the radial height difference between the first tooth height and the second tooth height is respectively between 0.001 mm and 0.1 mm, wherein preferably the second radial tooth height is respectively between 0.1% and 10% smaller or greater than the first radial tooth height (H1). It is advantageous if the at least one first corrugating tooth has a respectively greater or smaller, particularly maximum, radial tooth height than the at least one second corrugating tooth.

According to the invention, the at least one first and second corrugating teeth differ in terms of their tooth thickness in the peripheral direction, wherein the first tooth thickness and the second tooth thickness, at least regionally, differ from each other. It is advantageous if the at least one first corrugating tooth has, at least regionally, a respectively greater or smaller tooth thickness than the at least one second corrugating tooth. The difference in the tooth thickness is preferably between 0.001 mm and 0.1 mm.

According to the invention, flanks of the at least one first and second corrugating teeth run differently, at least regionally. For example, these flanks, at least regionally, have a different inclination and/or curvature than the corrugating roll body and/or the respective corrugating tooth crest. For example, the leading and/or trailing flanks of the first and second corrugating teeth run differently, at least regionally.

According to the invention, the roots or root regions of the at least one first and second corrugating teeth differ, at least regionally, particularly in their shape, or geometry. The roots or root regions are arranged adjacent to the respective crest or crest region of the corrugating tooth. It is advantageous if the at least one first corrugating tooth has, in its first root region, or, in the case of its first root, a first course, or a first curvature, especially a first curvature radius, which differs from a corresponding second course, or a corresponding curvature, particularly a second curvature radius, of the second root region, or root of the at least one second corrugating tooth. For instance, the first curvature radius of the first root region is between 0.9 mm and 2.5 mm. Alternatively, the root thicknesses of the first and second root regions differ in the peripheral direction.

According to the invention, the corrugating roll comprises several of the second corrugating teeth and has differently designed corrugating tooth valleys, in particular second corrugating tooth valleys, which are delimited in the peripheral direction by adjacent corrugating teeth, in particular two adjacent corrugating teeth, of the corrugating roll. The second corrugating tooth valley differs in its radial depth from the first corrugating tooth valley delimited by at least one corrugating tooth. For example, the first corrugating tooth valley is formed so that it is deeper or less deep than the second corrugating tooth valley. Preferably, the difference is between 0.001 mm and 0.1 mm.

The embodiment, in which the first corrugating teeth and the second corrugating teeth are arranged periodically with respect to each other on the corrugating roll body, is extremely advantageous in terms of operation-related vibrations. Furthermore, this allows the corrugating roll(s) to run particularly quietly. Alternatively, the first corrugating teeth and second corrugating teeth, at least regionally, are arranged aperiodically.

According to the invention in its peripheral direction the corrugating roll has varying pitches, in which a first pitch exists between the first corrugating teeth adjacently arranged in the peripheral direction, and a second pitch exists between a first corrugating tooth and the second corrugating tooth arranged adjacent to it in the peripheral direction, wherein the first pitch and the second pitch are different, wherein preferably the first pitch and the second pitch differ from each other by 0.005 mm to 0.1 mm in the peripheral direction. It is advantageous if the varying pitches are produced by varying tooth thicknesses of the first and second corrugating teeth. Preferably, the second corrugating teeth, at least regionally, have a smaller or greater second tooth thickness than the first corrugating teeth, which produces varying pitches.

Alternatively or additionally, the radii, or courses of the at least one first corrugating tooth and of the at least one second corrugating tooth are preferably different in terms of their corrugating crests and/or roots, which preferably produces varying pitches in the corrugating roll. Alternatively or additionally, advantageously, at least one flank angle of the at least one first corrugating tooth and of the at least one second corrugating tooth, particularly the leading and/or trailing flanks, is different, which preferably produces varying pitches in the corrugating roll.

The embodiment according to which the first pitch and the second pitch differ from each other by 0.005 mm to 0.1 mm in the peripheral direction produces an extremely uniformly impressed corrugated web and a particularly quiet running of the corrugating roll(s).

It is advantageous if every fourth of all of the corrugating teeth is a second corrugating tooth. Preferably, every third of all of the corrugating teeth is a second corrugating tooth.

Preferably, every second of all of the corrugating teeth is a second corrugating tooth. These are preferred distributions of the corrugating teeth.

Alternatively for example, every fifth, sixth or seventh tooth of all of the corrugating teeth is a second corrugating tooth.

The embodiment according to which every third of all of the corrugating teeth is a second corrugating tooth provides for a reduction of the ¼ (quarter) tooth frequency, or tooth meshing frequency during the operation of the corrugating roll.

The method, in which the machining of the basic corrugating teeth is performed by at least one machining tool such that in a first machining step, at least two basic corrugating teeth, arranged adjacent to each other, are always being at least partially machined simultaneously as the first corrugating teeth are being formed, and in a second machining step, after a relative displacement between the at least one machining tool and the corrugating roll basic body, at least one first corrugating tooth is always being at least partially machined again as the at least one second corrugating tooth is being formed by the at least one machining tool and, during the second machining step, at least one first corrugating tooth remains completely unmachined, is extremely effective. Advantageously, always exactly two basic corrugating teeth arranged adjacent to each other are machined essentially completely and two basic corrugating teeth arranged to the side of them are approximately half-machined simultaneously in a first operation by the at least one machining tool. In doing so, the two basic corrugating teeth machined essentially completely in the first operation are advantageously located between the two lateral basic corrugating teeth which are only essentially half-machined in the first operation.

After the next relative movement between the at least one machining tool and the corrugating roll basic body, in the second operation just one first corrugating tooth is again machined, at least regionally, while forming the second corrugating tooth, whereas the remaining first corrugating teeth, produced immediately before, remain unmachined this time. The doubly-machined corrugating tooth differs, therefore, from the just basically machined corrugating teeth and thus forms a second corrugating tooth. Advantageously, all basic corrugating teeth are machined in this manner to form the corrugating roll.

It is advantageous if, in order to produce the relative movement between the at least one machining tool and the corrugating roll basic body, the corrugating roll basic body is pivoted correspondingly. Alternatively, the at least one machining tool is pivoted relative to the corrugating roll basic body.

Advantageously, the crest and/or root of the respective corrugating tooth can be machined with the at least one machining tool.

Alternatively, at least one of the basic corrugating teeth is machined singly in order to obtain differing corrugating teeth.

Preferred embodiments of the invention are described below, by way of example, with reference to the attached drawings.

DESCRIPTION OF THE PREFERRED EMBODIMENTS

Figure 1:
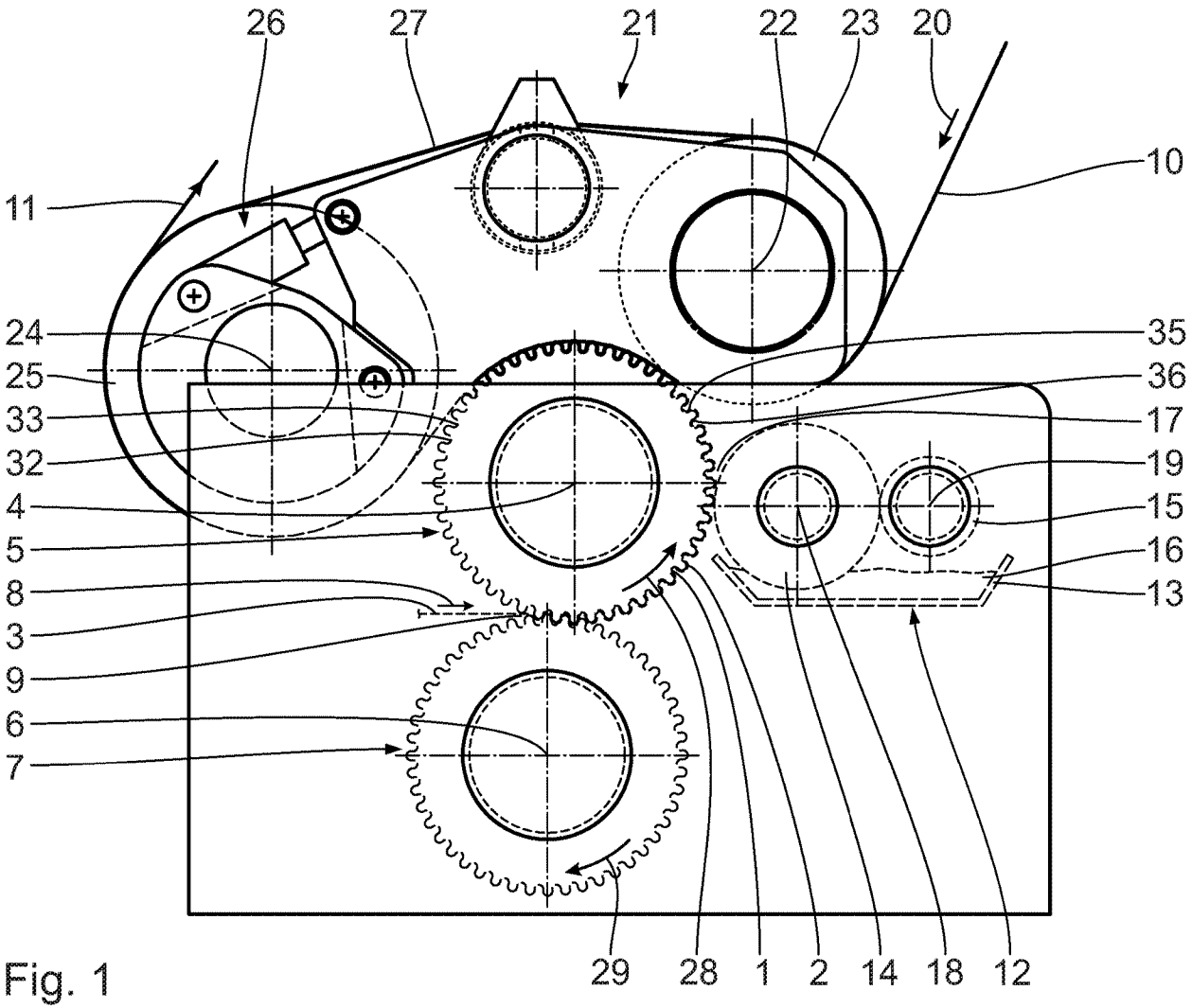
FIG. 1 shows a simplified side view of a device according to the invention to produce a corrugated cardboard web.

Firstly, referring to FIG. 1, a device for producing a corrugated cardboard web, which is a component part of a corrugated cardboard facility for producing cardboard and can also be designated as single facer, comprises a first corrugating roll 5 mounted to rotate about a first rotational axis 4 and a second corrugating roll 7 mounted to rotate about a second rotational axis 6 for producing a corrugated web 2 having a fluting 1 from a smooth or flat material web 3. Advantageously, the designs of the corrugating rolls 5, 7 are identical. The designs of the corrugating rolls 5, 7 can also be different. The rotational axes 4, 6 run parallel to each other and are perpendicular to a transportation direction 8 of the material web 3.

There is a roll slit 9 between the corrugating rolls 5, 7 to transport and corrugate the material web 3. Together, they form a corrugating arrangement.

In order to join the corrugated web 2 with a liner web 10 to a corrugated cardboard web 11, laminated on one side, the device for producing a corrugated cardboard web has an adhesive applicator 12 downstream from the corrugating rolls 5, 7, said adhesive applicator comprising in turn an adhesive container 13, an adhesive applying roll 14 dipping into the adhesive container 13 and an adhesive metering roll 15 abutting the adhesive adhesive applying roll 14. There is adhesive 16 in the adhesive container 13.

In order to transport and to apply adhesive to the corrugated web 2, the adhesive applying roll 14 forms an adhesive applying gap 17 with the first corrugating roll 5. The adhesive 16 located in the adhesive container 13 is applied, by means of the adhesive applying roll 14, dipped in said container and rotating about a third rotational axis 18 during operation, to the open tips of the fluting 1 of the corrugated web 2 transported in the transportation direction 8 and where it abuts the first corrugating roll 5. The adhesive metering roll 15 is arranged essentially opposite the first corrugating roll 5 and serves to form a uniform coating of adhesive on the adhesive applying roll 14. The adhesive metering roll 15 rotates during operation about its fourth rotational axis 19 which runs parallel to the third rotational axis 18, or to the rotational axes 4, 6.

The corrugated web 2 provided with the adhesive 16 together with the liner web 10 transported in a transportation device 20 are then jointly fed through the device for producing a corrugated cardboard web to obtain the corrugated cardboard web 11 laminated on one side.

In order to press the liner web 10 against the corrugated web 2 provided with the adhesive 16, where it abuts, at least regionally, the first corrugating roll 5, the device for producing a corrugated cardboard web has a pressing device 21, designed here as a pressing module and arranged downstream from the gluing gap 17 relative to the corrugated web 2.

The pressing device 21 is arranged above the first corrugating roll 5. It has a diverting roll 23 mounted to rotate about a fifth rotational axis 22 and a web tensioning- and/or web regulating roll 25 mounted to rotate about a sixth rotational axis 24 as well as a continuous pressure belt 27 fed around the diverting roll 23 and the web tensioning- and/or web regulating roll 25. The rotational axes 22, 24 run parallel to each other. They also extend parallel to the rotational axes 18, 19.

The web tensioning- and/or web regulating roll 25 is adjustable in terms of its distance from the diverting roll 23 to change the tensioning of the pressure belt 27 and/or in terms of its inclination to the diverting roll 23 to change the course of the pressure belt 27, or its lateral course. An appropriate web tensioning- and/or web regulation device 26 is present for this purpose, wherein said device engages directly or indirectly with the web tensioning- and/or web regulating roll 25 and comprises, for example, at least one adjusting cylinder unit whose length can be changed.

The first corrugating roll 5 engages from below, at least regionally, in a space existing between the diverting roll 23 and the web tensioning- and/or web regulating roll 25. The pressure belt 27 in this arrangement is diverted by the first corrugating roll 5. It presses against the liner web 10, which, in turn, is forced against the corrugated web 2 provided with the adhesive 16 and abuts the first corrugating roll 5.

A first splicing device (not shown) is advantageously provided for the device for producing a corrugated cardboard web to supply the material web 3 and a second splicing device (not shown) is provided to supply the liner web 10. Hence, the material web 3 is advantageously a continuous material web. It follows that the liner web 10 preferably also involves a continuous liner web, therefore. The corrugated cardboard web 11 laminated on one side is also continuous, therefore.

Also, a smooth laminating web/liner web (not shown) and/or at least one further corrugated cardboard web (not shown) laminated on one side can be applied to the corrugated web 2 in the cardboard device opposite the liner web 10. These are then glued together to form a lamination.

The fluting of the material web 3, or production of the corrugated web 2 is described in more detail below. During operation, the corrugating rolls 5, 7 rotate about their rotational axis 4, 6 in respectively opposite peripheral directions 28, 29. In doing so, the corrugating rolls 5, 7 mesh with each other, or engage into each other and thus form the material web 3 so that there is a corrugated web 2 downstream from the roll slit 9.

Figure 2:
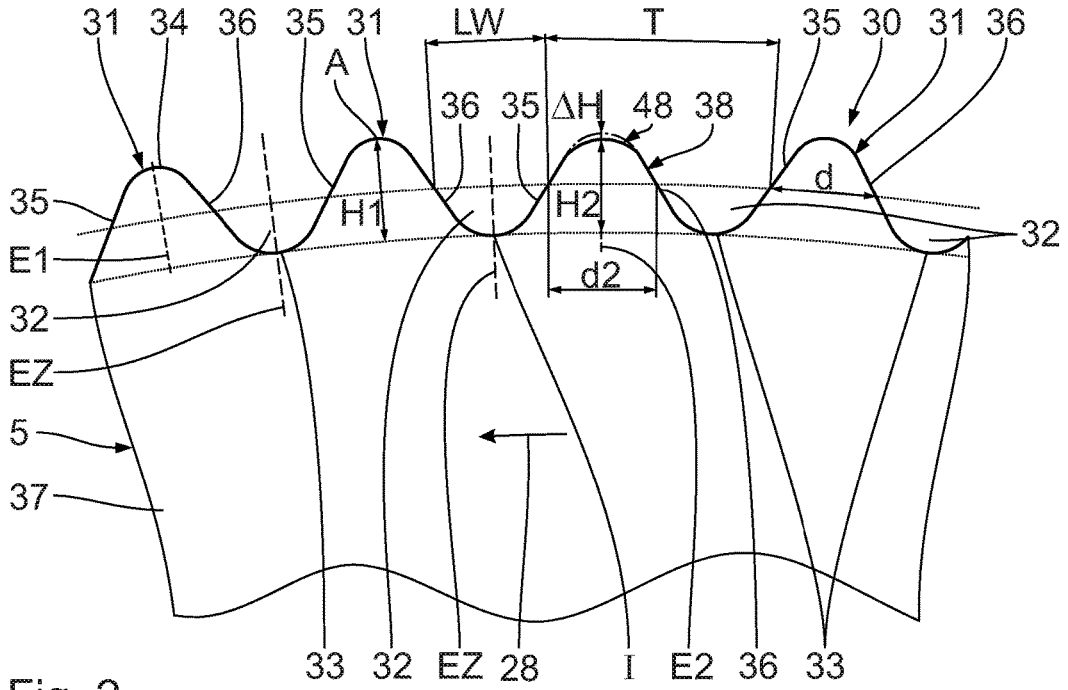
FIG. 2 shows an enlarged section of a corrugating roll according to the invention of the device shown in FIG. 1 to produce a corrugated cardboard web.

The first corrugating roll 5 is described below in more detail also with reference to FIG. 2. Since in this case the second corrugating roll 7 is designed in the same manner as the first corrugating roll 5, a detailed description of the second corrugating roll 7 is dispensed with for the sake of brevity. The following description of the first corrugating roll 5 applies essentially analogously for the second corrugating roll 7. Alternatively, the designs of the corrugating rolls 5, 7 are different. For example, the second corrugating roll 7 simply has identical corrugating teeth.

The first corrugating roll 5 has a corrugated first surface fluting 30 with alternately arranged corrugating teeth and corrugating tooth valleys 32. The corrugating teeth and the corrugating tooth valleys 32 run parallel to the first rotational axis 4. They are arranged alternately.

Each corrugating tooth valley 32 is delimited by the adjacent corrugating teeth both in the peripheral direction 28, 29 as well as radially inwards. Each corrugating tooth valley 32 is delimited radially inwards by a radially inner valley base face 33 of the corrugating teeth, which is concave relative to the first rotational axis 4. The corrugating tooth valleys 32 are essentially identical.

Each corrugating tooth has a radially outer corrugating tooth crest, which is convex relative to the first rotational axis 4. Furthermore, each corrugating tooth has a radially inner corrugating tooth root. The corrugating tooth crests can be directly adjacent to the neighbouring corrugating tooth roots. Alternatively, a corrugating tooth neck is arranged between each corrugating tooth crest and the associated corrugating tooth root.

Each corrugating tooth extends between two adjacent corrugating tooth valleys 32. In each corrugating tooth valley 32, a half of the valley base face 33 still belongs to the corrugating tooth, in fact the part adjacent to this corrugating tooth. Hence, as can be seen from FIG. 2, each corrugating tooth extends between planes EZ which divide the corrugating tooth valleys 32, or valley base faces 33 centrally in the radial direction.

Relative to the first peripheral direction 28, each corrugating tooth has a leading flank 35 and a trailing flank 36. Hence, the flanks 35, 36 extend from the corrugating tooth crest to the adjacent valley base face 33, or, respectively, the flanks 35, 36 form it. Hence, they extend from the radially outermost point A of each corrugating tooth to the radially innermost point I of each corrugating tooth. The radially innermost points I lie in the planes EZ, whereas the radially outermost points A are located centrally between adjacent planes EZ.

The corrugating teeth extend outwards from a cylindrical corrugating roll body 37. Each corrugating tooth has a radial tooth height with respect to the first rotational axis 4 and extending out from the corrugating roll body 37. The radial tooth height of the corrugating tooth is maximal at points A, whereas it is minimal at points I, or is 0, respectively.

In the first peripheral direction 28, the corrugating teeth are essentially identical with respect to their tooth thickness. The corrugating teeth taper radially outwards.

The first corrugating roll 5 has a constant pitch T between adjacent corrugating teeth in the first peripheral direction 28.

The first corrugating roll 5 has constant gap widths LW in the first peripheral direction 28, or identical corrugating tooth valleys 32, between adjacent corrugating teeth.

The first corrugating roll 5 has different corrugating teeth. The first surface fluting 30 is formed, therefore, by differing corrugating teeth.

The first corrugating roll 5 has a multiplicity of first corrugating teeth 31 and several second corrugating teeth 38 which differ in their respective maximum radial heights from the first corrugating teeth 31. Measured from the corrugating roll body 37, the first corrugating teeth 31 each have a maximum radial height H1, whereas the second corrugating teeth 38, measured from the corrugating roll body 37, each have a maximum radial height H2. The respective maximum radial height H2 is smaller than the respective maximum radial height H1. As a comparison, in FIG. 2 in the case of the illustrated second corrugating tooth 38, the shape of a higher first corrugating tooth 31 is also illustrated at the same time with a dotted line.

Both the first corrugating teeth 31 as well as the second corrugating teeth 38 have a convex corrugating crest. The first corrugating teeth 31 have a first corrugating crest 34 with a first crest curvature, whereas the second corrugating teeth 38 have a second corrugating crest 48 with a second crest curvature. In the case of the first crest curvature, a first crest curvature radius is present which is smaller than a second crest curvature radius of the second crest curvature.

The flanks 35, 36 of the first and second corrugating teeth 31, 38 run, irrespective of the corrugating crests 38, 48, identically relative to the corrugating roll body 37, or relative to the rotational axis 4. The tooth thickness d, d2 of the first and second corrugating teeth 31, 38 is essentially identical. It only differs with the corrugating crests 38, 48. The pitches T between first corrugating teeth 31 and between first and second corrugating teeth 31, 38 are identical.

The first corrugating teeth 31 each have cross sections which are designed symmetrically relative to a first corrugating tooth plane E1. The second corrugating teeth 38 each have cross sections which are designed symmetrically relative to a second corrugating tooth plane E2. The corrugating tooth planes E1, E2 pass through points A.

Advantageously, every third tooth of all of the corrugating teeth involves a second corrugating tooth 38. The remaining corrugating teeth are preferably first corrugating teeth 31. Therefore, more first corrugating teeth 31 than second corrugating teeth 38 are present in the case of the first corrugating roll 5. The arrangement of the first and second corrugating teeth 31, 38 is periodic or regular.

Figure 3:
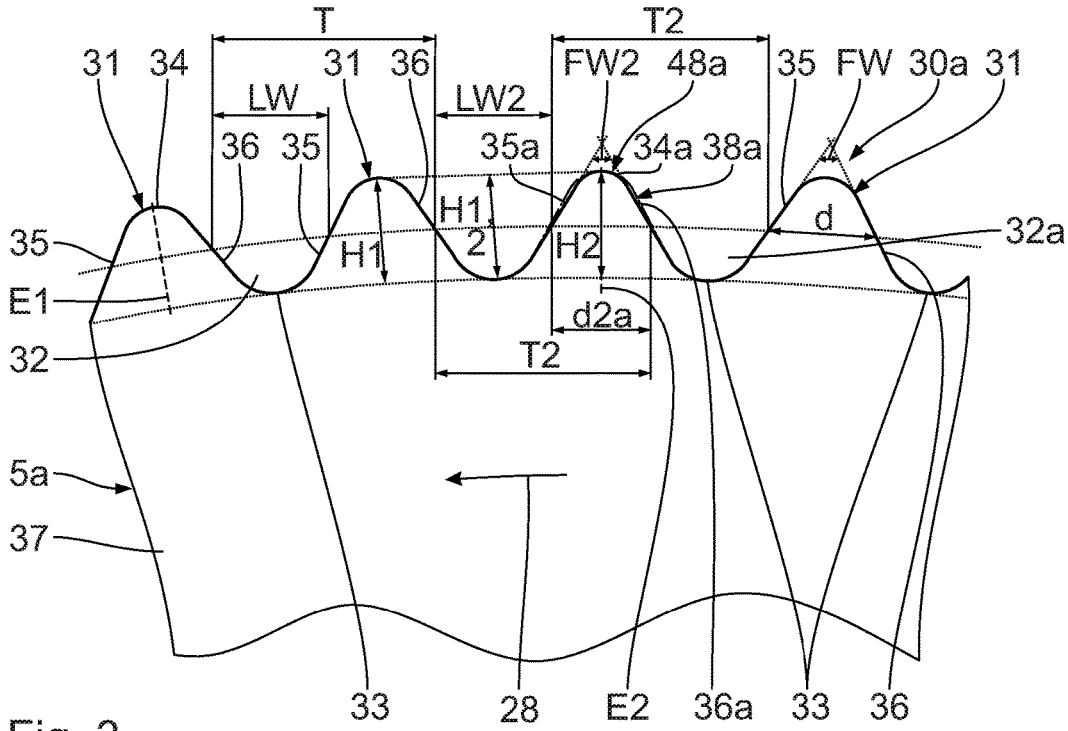
FIG. 3 shows an enlarged section of a corrugating roll according to the invention according to a second embodiment which can be used instead of the corrugating roll shown in FIG. 2.

A description of a second embodiment of the first corrugating roll 5*a* follows below with reference to FIG. 3. Identical elements or regions carry the same identifying symbols as the previous embodiment to whose description reference will be made. Functionally identical elements, but with different designs, carry the same identifying symbols with "a" placed after them.

The first corrugating roll 5*a* in this case has second corrugating teeth 38*a*, which differ in their tooth thickness d2*a* from the tooth thickness d of the first corrugating teeth 31. The respective tooth thickness d2 is smaller than the tooth thickness d. Alternatively, the tooth thickness d2 is greater than the tooth thickness d.

The result of the different thicknesses of the first and second corrugating teeth 31, 38*a* is that the gap width LW2 between a second corrugating tooth 38*a* and an adjacent first corrugating tooth 31 respectively associated with it is greater than the gap width LW between two adjacently arranged first corrugating teeth 31.

Furthermore, the pitch T2 between a first corrugating tooth 31 and a second corrugating tooth 38*a* respectively arranged adjacent to it is smaller than the pitch T between two adjacently arranged first corrugating teeth 31.

The maximum radial tooth heights H1, H2 of the first and second corrugating teeth 31, 38*a* are identical in each case.

The respective reduced tooth thickness d2 of the second corrugating teeth 38*a* results also from a narrower corrugating tooth crest 48*a* compared with the first corrugating teeth 31. The flanks 35*a*, 36*a* of the second corrugating teeth 38*a* each enclose a flank angle FW2 which is smaller than the respective flank angle FW of flanks 35, 36 of the first corrugating teeth 31.

The second corrugating tooth valley 32*a*, delimited by a second corrugating tooth 38*a*, thus differs respectively in its width in a peripheral direction 28, 29 from a corrugating tooth valley 32 which is delimited only by first corrugating teeth 31.

The first corrugating teeth 31 each have cross sections which are designed symmetrically relative to a first corrugating tooth plane E1. The second corrugating teeth 38*a* each have cross sections which are designed symmetrically relative to a second corrugating tooth plane E2.

As in the case of the previous embodiment, every third of all of the corrugating teeth involves a second corrugating tooth 38*a*.

Figure 4:
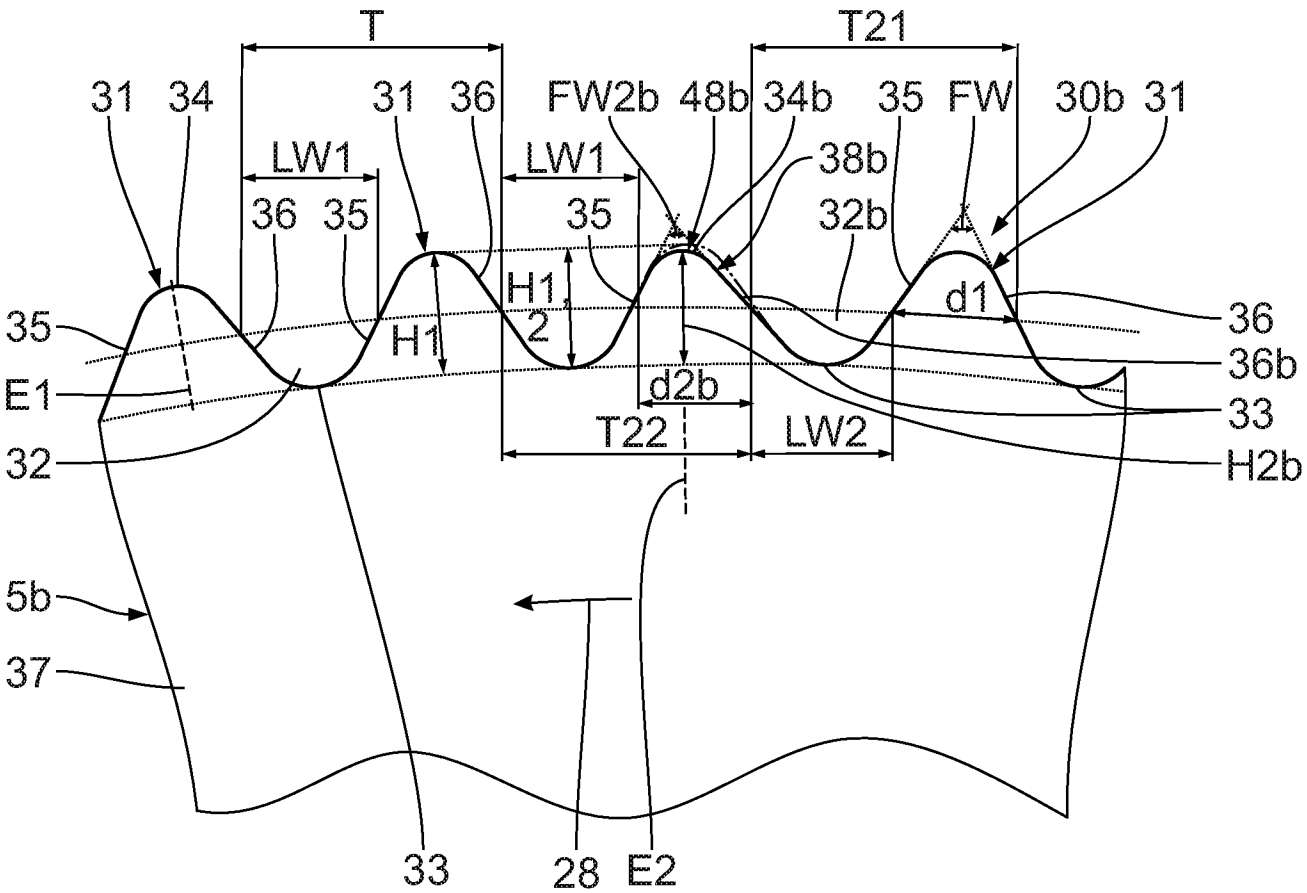
FIG. 4 shows an enlarged section of a corrugating roll according to the invention according to a third embodiment which can be used instead of the corrugating roll shown in FIG. 2.

A description of a third embodiment of the first corrugating roll 5*b* follows below with reference to FIG. 4. Identical elements or regions carry the same identifying symbols as the previous embodiments to whose description reference will be made. Functionally identical elements, but with different designs, carry the same identifying symbols with "b" placed after them.

Compared with the first corrugating teeth 31, the second corrugating teeth 38*b* each have a reduced maximum radial, second tooth height H2*b* and a reduced second tooth thickness d2*b*. The flank angle FW2*b* of the second corrugating teeth 38*b* is smaller than the respective flank angle FW of the first corrugating teeth 31.

The course of the leading flanks 35 of the second corrugating teeth 38*b* correspond essentially to that of the leading flanks 35 of the first corrugating teeth 31. They have an identical inclination to the corrugating roll body 37 or to the rotational axis 4.

The reduced tooth thickness d2*b* and the changed flank angle FW2*b* are each produced simply by the changed course of the trailing flank 36*b* of the second corrugating teeth 38*b*. The tooth crest 48*b* of the second corrugating teeth 38*b* is narrower in each case compared with the tooth crest 34 of the first corrugating teeth 31.

The pitch T21 between the second corrugating teeth 38*b* and the respective trailing first corrugating tooth 31, relative to the respective trailing flanks 36, 36*b*, is respectively greater than the corresponding pitch T between the adjacently arranged first corrugating teeth 31.

The pitch T22 between the second corrugating teeth 38*b* and the respective leading first corrugating tooth 31, relative to the trailing flanks 36, 36*b*, is respectively smaller than the corresponding pitch T between the adjacently arranged first corrugating teeth 31.

Thus the second corrugating tooth valley 32*b* delimited by the trailing tooth flank 36*b* of the second corrugating teeth 38*b* and a first corrugating tooth 31 differs respectively in its width in the peripheral direction 28, 29 from a corrugating tooth valley 32, which is delimited by two first corrugating teeth 31, or by a first corrugating tooth 31 and the leading flank 35 of the second corrugating teeth 38*b*. The second corrugating tooth valley 32*b* is wider than the first corrugating tooth valley 32.

The first corrugating teeth 31 each have cross sections which are designed symmetrically relative to a first corrugating tooth plane E1. The second corrugating teeth 38*b* each have cross sections which are designed symmetrically relative to a second corrugating tooth plane E2.

As in the case of the previous embodiment, every third tooth of all of the corrugating teeth is a second corrugating tooth 38*b*.

A description of a fourth embodiment of the first corrugating roll 5*c* follows below with reference to FIG. 5. Identical elements or regions carry the same identifying symbols as the previous embodiment to whose description reference will be made. Functionally identical elements, but with different designs, carry the same identifying symbols with "c" placed after them.

The first corrugating roll 5*c* in this case has second corrugating teeth 38*c*, which are arranged immediately next to each other in the peripheral direction 28, 29 and differ in their root region from the first corrugating teeth 31. In each case, two second corrugating teeth 38*c* are arranged immediately following one another in the peripheral direction 28, 29.

The radially inner, second valley base face 33*c* respectively between two second corrugating teeth 38*c* is displaced radially outwards compared with the first valley base faces 33 of two adjacently arranged, first corrugating teeth 38. The second corrugating tooth valley 32*c* delimited by the radially outwardly displaced, second valley base face 33*c* in this case has a second radial, in particular maximum, valley depth which is smaller than the first radial, in particular maximum, valley depth, which is defined by at least one first corrugating tooth 31. The respective second valley base face 33*c* is advantageously radially outwardly displaced between 0.001 mm and 0.1 mm compared with the first valley base faces 33. Thus, the second corrugating teeth 38*c* have a corrugating tooth root which differs from the first corrugating teeth 31.

Relative to the radially outwardly displaced, second valley base face 33*c* the second corrugating teeth 38*c* have a smaller radial maximum height than the first corrugating teeth 31. Relative to the corrugating roll body 37, the first and second corrugating teeth 31, 38*c* have an identical maximum radial height.

The flanks 35*c*, 36*c* of the respective second corrugating teeth 38*c* delimiting a second corrugating tooth valley 32*c* are shortened compared with the flanks 35, 36 of the respective first corrugating teeth 31 which delimit a first corrugating tooth valley 32. The flanks 35*c*, 36*c* of every second corrugating tooth 38*c* each have the same length.

The curvature radius of the second valley base face 33*c* is greater than the curvature radius of a first valley base face 33.

The tooth thickness d2, d2*c* of the first and second corrugating teeth 31, 38*d* is essentially identical. It differs only in the roots.

The second corrugating tooth valleys 32*c* differ in their shape, or radial depth, from the first corrugating tooth valleys 32.

Figure 6:
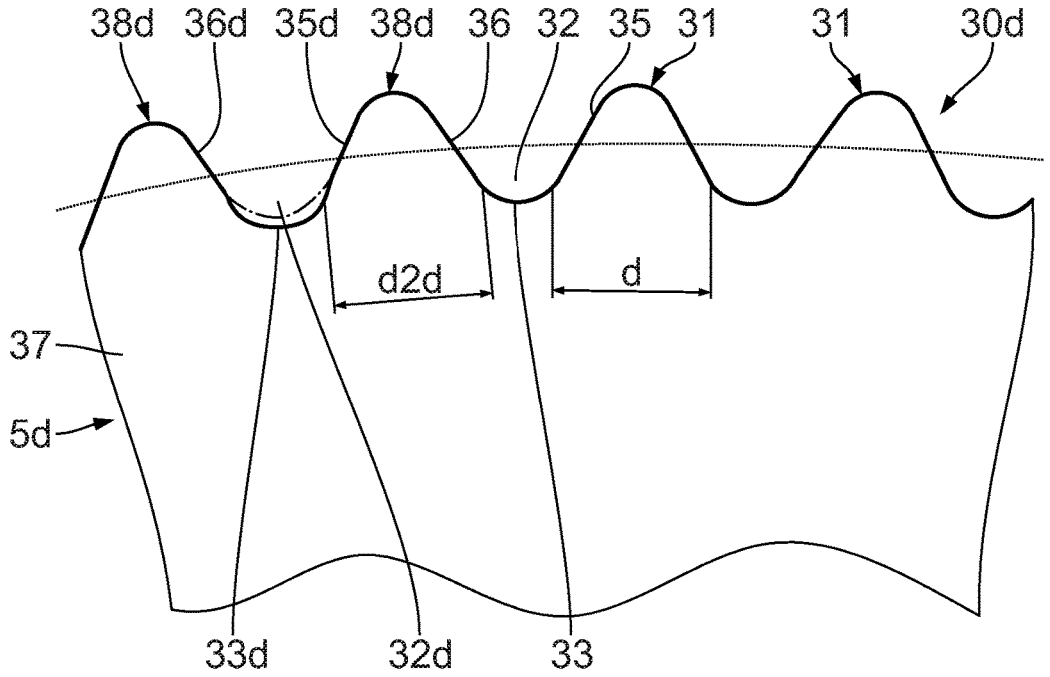
FIG. 6 shows an enlarged section of a corrugating roll according to the invention according to a fifth embodiment which can be used instead of the corrugating roll shown in FIG. 2.

A description of a fifth embodiment of the first corrugating roll 5*d* follows below with reference to FIG. 6. Identical elements or regions carry the same identifying symbols as the previous embodiment to whose description reference will be made. Functionally identical elements, but with different designs, carry the same identifying symbols with "d" placed after them.

Figure 5:
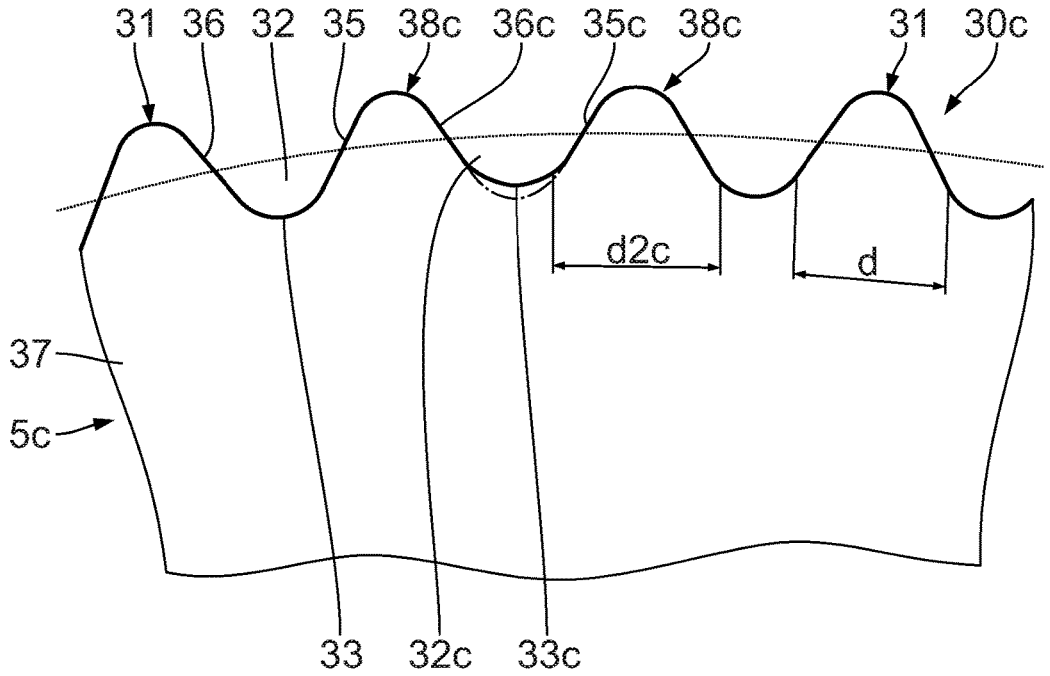
FIG. 5 shows an enlarged section of a corrugating roll according to the invention according to a fourth embodiment which can be used instead of the corrugating roll shown in FIG. 2.

Compared with the embodiment according to FIG. 5, in this case the second valley base faces 33*d* of two second corrugating teeth 38*d* following one another in the peripheral direction 28, 29 are radially inwardly displaced compared with the first valley base faces 33. Thus, the second corrugating teeth 38*d* have a different corrugating tooth root than the first corrugating teeth 31.

The flanks 35*d*, 36*d* of every second corrugating tooth 38*d* are each longer than the flanks 35, 36 of every first corrugating tooth 31. The second corrugating tooth valleys 32*d* differ in their shape from the first corrugating tooth valleys 32. They are deeper than the first corrugating tooth valleys 32. Advantageously, the second corrugating tooth valleys 32*d* are each deeper than the first corrugating tooth valleys 32 by 0.001 mm to 0.1 mm.

The tooth thickness d, d2*d* of the first and second corrugating teeth 31, 38*d* is different in the roots.

Figure 7:
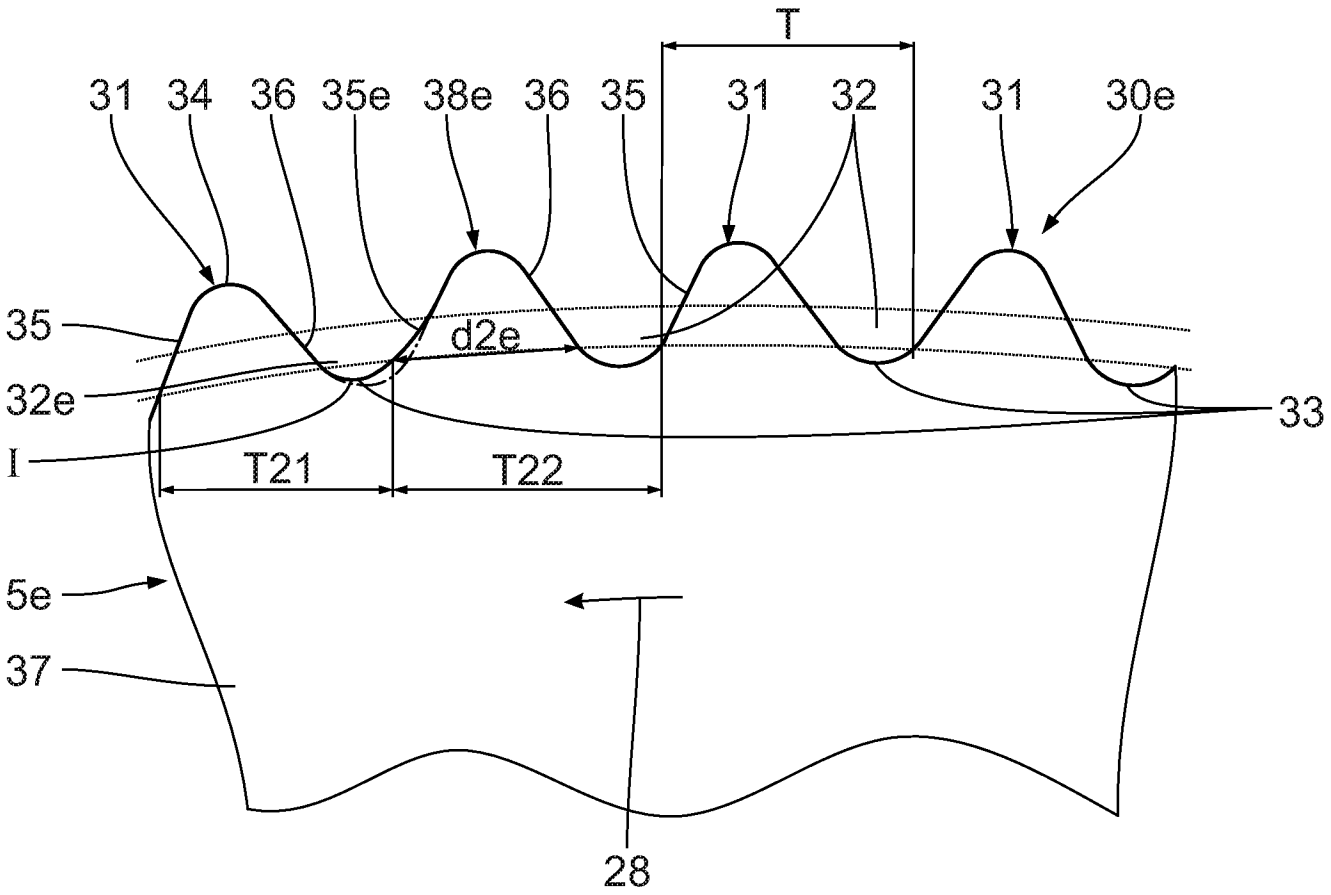
FIG. 7 shows an enlarged section of a corrugating roll according to the invention according to a sixth embodiment which can be used instead of the corrugating roll shown in FIG. 2.

A description of a sixth embodiment of the first corrugating roll 5*e* follows below with reference to FIG. 7. Identical elements or regions carry the same identifying symbols as the previous embodiment to whose description reference will be made. Functionally identical elements, but with different designs, carry the same identifying symbols with "e" placed after them.

Compared with the first corrugating teeth 31, the second corrugating teeth 38*e* have a leading flank 35*e* which runs differently. The inclination, or gradient of flank 35*e* differs, particularly in each root region, from the leading flanks 35 of the first corrugating teeth 31. The flanks 35*e* of the second corrugating teeth 38*e* run less steeply than the flanks 35 of the first corrugating teeth 31 relative to the corrugating roll body 37. The flanks 35*e* of the second corrugating teeth 38*e* run less steeply than the trailing flanks 36 of the second corrugating teeth 38*e* relative to the corrugating roll body 37. Starting from point I, the first flanks 35*e* run more quickly upwards than the first flanks 35 of the first corrugating teeth 31. The tooth thickness d, d2*e* of the first and second corrugating teeth 31, 38*e* differs in the roots.

By having different roots for the first and second corrugating teeth 31, 38*e* the first and second corrugating tooth valleys 32, 32*e* differ also in their radial depth or width from each other.

First corrugating teeth 31 are arranged to be adjacent to the second corrugating teeth 38*e*. The pitch T21 between the second corrugating teeth 38*e* and the respectively following first corrugating tooth 31, with respect to the respective leading flanks 35, 35*e*, is, in each case, greater than the corresponding pitch T between the adjacently arranged first corrugating teeth 31.

The pitch T22 between the second corrugating teeth 38*e* and the respectively leading first corrugating tooth 31, with respect to the leading flanks 35, 35*e*, is, in each case, smaller than the corresponding pitch T between the adjacently arranged first corrugating teeth 31.

A device for producing a corrugating roll 5, 7 and the manufacturing method associated with it is described below with reference to FIG. 8.

The device comprises a mounting facility 39 for mounting a corrugating roll basic body 40 requiring machining which has a basic surface fluting 41 with basic corrugating teeth 47. The mounting facility 39 allows the corrugating roll basic body 40 to pivot about its central axis.

In order to machine the basic surface fluting 41, the device has a grinding wheel 42, which can be displaced relative to the corrugating roll basic body 40 between a machining position to machine the corrugating roll basic body 40 and a non-machining position at a distance from the corrugating roll basic body 40. The grinding wheel 42 is designed in the shape of a disc with a pivot axis 49. It can be driven rotationally. In operation, the grinding wheel 42 rotates about its pivot axis 49.

On its open peripheral region 43, the grinding wheel 42 has three identical grinding projections 44 arranged adjacent to each other, each of which is peripheral and runs about the pivot axis 49. The grinding projections 44 are arranged with uniform axial gaps between each other looking towards the pivot axis 49. In cross section, each of them is essentially triangular in shape and each has a rounded grinding tip 45. Each grinding tip 45 is convex with respect to the pivot axis 49.

The grinding wheel 42 has peripheral grinding grooves 50, each with a rounded root 46 and each between said adjacently arranged grinding projections 44. The grinding grooves 50 narrow down to their root 46. Each root 46 is concave relative to the pivot axis 49.

The grinding projections 44, or grinding grooves 50, are arranged, in size and shape, such that they are suitable for forming the first corrugating teeth 31.

Figure 8:
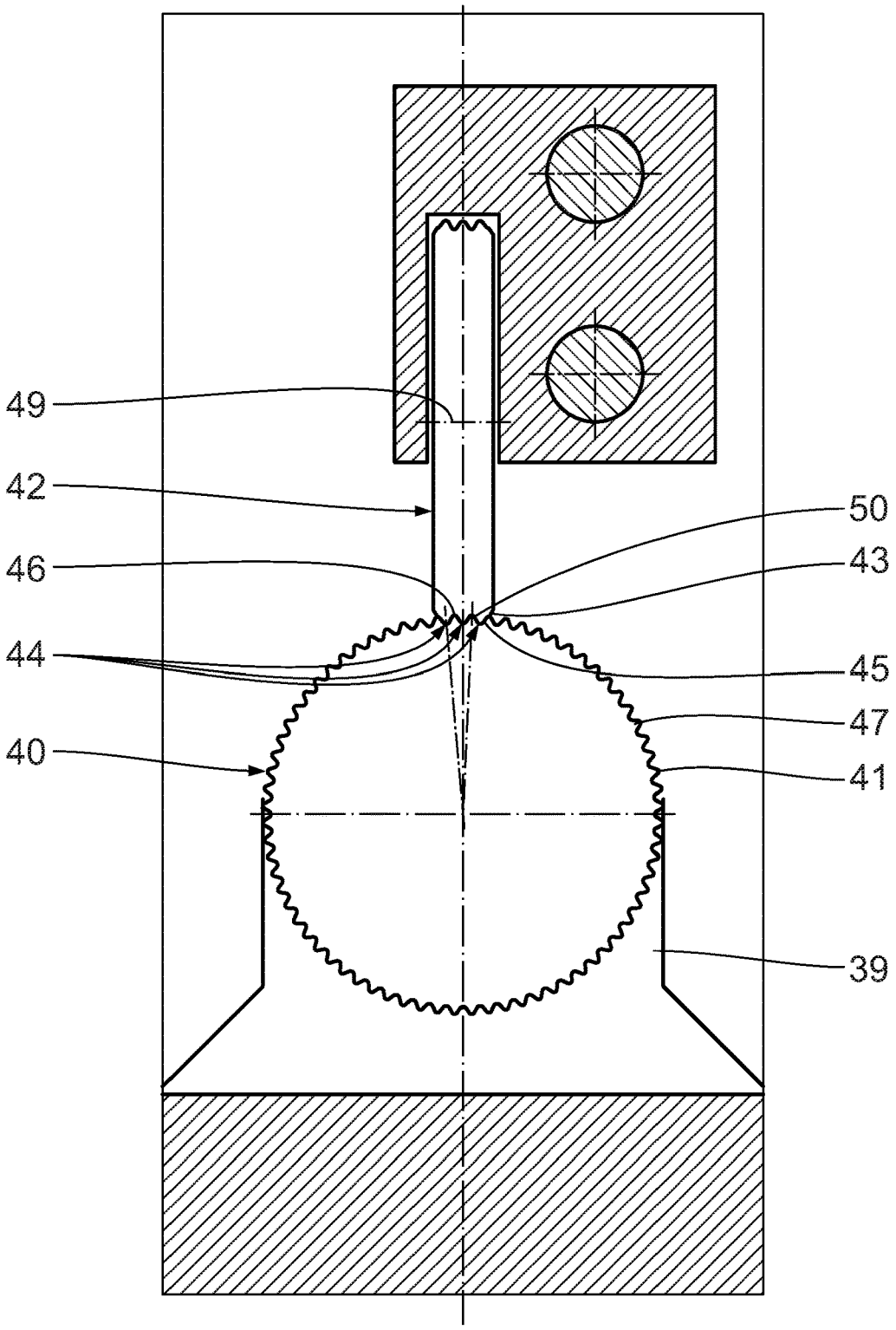
FIG. 8 shows a simplified device for producing the corrugating rolls according to the invention which are illustrated in FIGS. 2 to 7.

When the grinding wheel 42 is located in its machining position shown in FIG. 8, in a first grinding step, the three grinding projections 44 of the rotating grinding wheel 42 engage simultaneously in three adjacent valleys of the corrugating roll basic body 40 and engage in a grinding action on flanks of the corrugating roll basic body 40 while the two grinding grooves 50 abut the basic corrugating teeth 47 while grinding. By machining material from the basic corrugating teeth 47, the first corrugating teeth 31, or the corrugating tooth valleys 32, are produced.

After this first grinding step, the corrugating roll basic body 40 is pivoted in its peripheral direction by two basic corrugating teeth 47, or two first corrugating teeth 31 relative to the grinding wheel 42 with the grinding wheel 42 lifted away from the corrugating roll basic body 40.

Then the rotating grinding wheel 42 is placed again in its machining position. In doing so, two new corrugating roll basic teeth 47 are newly machined resulting in more first corrugating teeth 31. In doing so, a first corrugating tooth 31 is again machined resulting in further removal of material to produce the second corrugating tooth 38, 38*a*, 38*b*, 38*c*, 38*d*, 38*e*. The grinding projections 44 are shaped corresponding to the various second corrugating teeth 38, 38*a*, 38*b*, 38*c*, 38*d*, 38*e*. The second corrugating teeth 38, 38*a*, 38*b*, 38*c*, 38*d*, 38*e* are produced, therefore, from the first corrugating teeth 31, or in the machining of the corrugating roll basic body 40.

Alternatively, the corrugating roll basic body 40 is pivoted in its peripheral direction by more than two basic corrugating teeth 47, or two first corrugating teeth 31, relative to the grinding wheel. This takes place particularly when the grinding wheel has more than the stated, that is, more than three grinding projections 44.

Combinations of the disclosed embodiments are possible.

What is claimed is:

1. A corrugating roll for producing a corrugated web, having a fluting, from a material web, the corrugating roll comprising:

a corrugating roll body;

a central longitudinal axis;

a peripheral direction about the central longitudinal axis; and a surface fluting comprising at least one first corrugating tooth and at least one second corrugating tooth, the at least one first corrugating tooth being arranged peripherally on the corrugating roll body, the at least one second corrugating tooth being arranged peripherally on the corrugating roll body and the at least one second corrugating tooth differing from the at least one first corrugating tooth for reducing corrugating roll operation-related vibrations, the at least one first corrugating tooth having a first crest curvature and the at least one second corrugating tooth having a second crest curvature, wherein the first crest curvature and the second crest curvature, at least regionally, are different, wherein the at least one first corrugating tooth has a first radial tooth height measured from the corrugating roll body and the at least one second corrugating tooth has a second radial tooth height measured from the corrugating roll body, wherein there is a respective radial height difference between the first radial tooth height and the second radial tooth height.

2. A corrugating roll according to claim 1, wherein the at least one first corrugating tooth has a first tooth form and the at least one second corrugating tooth has a second tooth form, wherein the first tooth form and the second tooth form, at least regionally, are different.

3. A corrugating roll according to claim 1, wherein the at least one first corrugating tooth has a first crest form and the at least one second corrugating tooth has a second crest form, wherein the first crest form and the second crest form, at least regionally, differ from each other, wherein a contour of the at least one first corrugating tooth is different from a contour of the at least one second corrugating tooth, each of the at least one first corrugating tooth and the at least one second corrugating tooth comprising a corrugating roller contact surface for engaging another corrugating roll.

4. A corrugating roll according to claim 1, wherein the radial height difference between the first tooth height and the second tooth height is respectively between 0.001 mm and 0.1 mm.

5. A corrugating roll according to claim 1, wherein the second radial tooth height is respectively between 0.1% and 10% one of smaller and greater than the first radial tooth height.

6. A corrugating roll according to claim 1, wherein the at least one first corrugating tooth has a first tooth thickness in the peripheral direction and the at least one second corrugating tooth has a second tooth thickness in the peripheral direction, wherein the first tooth thickness and the second tooth thickness, at least regionally, differ from each other.

7. A corrugating roll according to claim 1, wherein the at least one first corrugating tooth has at least one first flank and the at least one second corrugating tooth has at least one second flank, wherein the at least one first flank and the at least one second flank, at least regionally, differ from each other in their course.

8. A corrugating roll according to claim 1, wherein the at least one first corrugating tooth has a first root and the at least one second corrugating tooth has a second root, wherein the first root and the second root, at least regionally, differ from each other.

9. A corrugating roll according to claim 8, wherein the surface fluting comprises another second corrugating tooth to provide at least a plurality second corrugating teeth, wherein, respectively, a second corrugating tooth valley is delimited by two adjacently arranged second corrugating teeth and differs in its radial depth from a first corrugating tooth valley delimited by at least one corrugating tooth.

10. A corrugating roll according to claim 1, wherein the surface fluting comprises another first corrugating tooth to provide at least a plurality of first corrugating teeth and the surface fluting comprises several second corrugating teeth.

11. A corrugating roll according to claim 10, wherein the first corrugating teeth and the second corrugating teeth are arranged periodically with respect to each other on the corrugating roll body.

12. A corrugating roll according to claim 10, wherein a first pitch exists between the first corrugating teeth adjacently arranged in the peripheral direction, and a second pitch exists between a first corrugating tooth and the second corrugating tooth arranged adjacent to the first corrugating tooth in the peripheral direction, wherein the first pitch and the second pitch are different.

13. A corrugating roll according to claim 10, wherein a first pitch exists between the first corrugating teeth adjacently arranged in the peripheral direction, and a second pitch exists between a first corrugating tooth and the second corrugating tooth arranged adjacent to the first corrugating tooth in the peripheral direction, wherein the first pitch and the second pitch differ from each other by 0.005 mm to 0.1 mm in the peripheral direction.

14. A device for producing a corrugated cardboard web, the device comprising:

a corrugating device for producing a corrugated web from a material web, the corrugated web having a corrugated web fluting, wherein the corrugating device comprises at least one corrugating roll for producing the corrugated web, having the corrugated web fluting, the corrugating roll comprising a corrugating roll body, a central longitudinal axis, a peripheral direction about the central longitudinal axis, and a surface fluting, the surface fluting having at least one first corrugating tooth, arranged peripherally on the corrugating roll body, and at least one second corrugating tooth arranged peripherally on the corrugating roll body and the at least one second corrugating tooth differs from the at least one first corrugating tooth for reducing corrugating roll operation-related vibrations, the at least one first corrugating tooth having a first crest curvature and the at least one second corrugating tooth having a second crest curvature, wherein the first crest curvature and the second crest curvature, at least regionally, are different, wherein the at least one first corrugating tooth has a first radial tooth height measured from the corrugating roll body and the at least one second corrugating tooth has a second radial tooth height measured from the corrugating roll body, wherein there is a respective radial height difference between the first radial tooth height and the second radial tooth height;

an adhesive applicator to apply adhesive to tips of the corrugated web fluting of the corrugated web; and a pressing device to press a liner web on to the glue-covered tips of the corrugated web.

15. A method for producing a material web corrugating roll, the method comprising the steps:

providing a corrugating roll basic body with basic corrugating teeth; and machining the basic corrugating teeth upon forming first corrugating teeth and at least one second corrugating tooth, such that the at least one second corrugating tooth differs from the first corrugating teeth for reducing corrugating roll operation-related vibrations, the at least one first corrugating tooth having a first crest curvature and the at least one second corrugating tooth having a second crest curvature, wherein the first crest curvature and the second crest curvature, at least regionally, are different.

16. A method according to claim 15, wherein machining the basic corrugating teeth is performed by at least one machining tool such that:

in a first machining step, at least two basic corrugating teeth, arranged adjacent to each other, are always being at least partially machined simultaneously as the first corrugating teeth are being formed; and in a second machining step, after a relative displacement between the at least one machining tool and the corrugating roll basic body, at least one first corrugating tooth is always being at least partially machined again upon forming the at least one second corrugating tooth by the at least one machining tool and, during the second machining step, at least one first corrugating tooth remains completely unmachined.

17. A method for producing a material web corrugating roll, the method comprising the steps:

providing a corrugating roll basic body with basic corrugating teeth; and machining the basic corrugating teeth upon forming first corrugating teeth and at least one second corrugating tooth, such that the at least one second corrugating tooth differs from the first corrugating teeth for reducing corrugating roll operation-related vibrations, wherein the machining of the basic corrugating teeth is performed by at least one machining tool such that:

in a first machining step, at least two basic corrugating teeth, arranged adjacent to each other, are always being at least partially machined simultaneously as the first corrugating teeth are being formed; and in a second machining step, after a relative displacement between the at least one machining tool and the corrugating roll basic body, at least one first corrugating tooth is always being at least partially machined again as the at least one second corrugating tooth is being formed by the at least one machining tool and, during the second machining step, at least one first corrugating tool remains completely unmachined.

18. A corrugating roll for producing a corrugated web, having a fluting, from a material web, the corrugating roll comprising:

a corrugating roll body;

a central longitudinal axis;

a peripheral direction about the central longitudinal axis; and a surface fluting comprising at least one first corrugating tooth and at least one second corrugating tooth, the at least one first corrugating tooth being arranged peripherally on the corrugating roll body, the at least one second corrugating tooth being arranged peripherally on the corrugating roll body and the at least one second corrugating tooth differing from the at least one first corrugating tooth for reducing corrugating roll operation-related vibrations, the at least one first corrugating tooth having a first crest curvature and the at least one second corrugating tooth having a second crest curvature, wherein the first crest curvature and the second crest curvature, at least regionally, are different, wherein the at least one first corrugating tooth has at least one first flank and the at least one second corrugating tooth has at least one second flank, wherein the at least one first flank and the at least one second flank, at least regionally, differ from each other in their course.

19. A corrugating roll for producing a corrugated web, having a fluting, from a material web, the corrugating roll comprising:

a corrugating roll body;

a central longitudinal axis;

a peripheral direction about the central longitudinal axis; and a surface fluting comprising at least one first corrugating tooth and at least one second corrugating tooth, the at least one first corrugating tooth being arranged peripherally on the corrugating roll body, the at least one second corrugating tooth being arranged peripherally on the corrugating roll body and the at least one second corrugating tooth differing from the at least one first corrugating tooth for reducing corrugating roll operation-related vibrations, the at least one first corrugating tooth having a first crest curvature and the at least one second corrugating tooth having a second crest curvature, wherein the first crest curvature and the second crest curvature, at least regionally, are different, the at least one first corrugating tooth having a first root and the at least one second corrugating tooth having a second root, wherein the first root and the second root, at least regionally, differ from each other, the surface fluting comprising another second corrugating tooth to provide at least a plurality second corrugating teeth, wherein, respectively, a second corrugating tooth valley is delimited by two adjacently arranged second corrugating teeth and differs in its radial depth from a first corrugating tooth valley delimited by at least one corrugating tooth.

20. A corrugating roll for producing a corrugated web, having a fluting, from a material web, the corrugating roll comprising:

a corrugating roll body;

a central longitudinal axis;

a peripheral direction about the central longitudinal axis; and a surface fluting comprising at least one first corrugating tooth and at least one second corrugating tooth, the at least one first corrugating tooth being arranged peripherally on the corrugating roll body, the at least one second corrugating tooth being arranged peripherally on the corrugating roll body and the at least one second corrugating tooth differing from the at least one first corrugating tooth for reducing corrugating roll operation-related vibrations, the at least one first corrugating tooth having a first crest curvature and the at least one second corrugating tooth having a second crest curvature, wherein the first crest curvature and the second crest curvature, at least regionally, are different, the surface fluting comprising another first corrugating tooth to provide at least a plurality of first corrugating teeth and the surface fluting comprising several second corrugating teeth, wherein a first pitch exists between the first corrugating teeth adjacently arranged in the peripheral direction, and a second pitch exists between a first corrugating tooth and the second corrugating tooth arranged adjacent to the first corrugating tooth in the peripheral direction, wherein the first pitch and the second pitch are different.

* * * * *